US010370937B2

(12) United States Patent
Pabon et al.

(10) Patent No.: US 10,370,937 B2
(45) Date of Patent: Aug. 6, 2019

(54) FRACTURING SLEEVES AND METHODS OF USE THEREOF

(71) Applicant: SCHLUMBERGER TECHNOLOGY CORPORATION, Sugar Land, TX (US)

(72) Inventors: Jahir Pabon, Newton, MA (US); Matthew Godfrey, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 87 days.

(21) Appl. No.: 14/821,080

(22) Filed: Aug. 7, 2015

(65) Prior Publication Data

US 2017/0037705 A1 Feb. 9, 2017

(51) Int. Cl.

| | |
|---|---|
| ***E21B 34/10*** | (2006.01) |
| ***E21B 33/12*** | (2006.01) |
| ***E21B 34/14*** | (2006.01) |
| ***E21B 23/02*** | (2006.01) |
| ***E21B 43/16*** | (2006.01) |
| *E21B 34/00* | (2006.01) |

(52) U.S. Cl.
CPC ..... *E21B 34/14* (2013.01); *E21B 2034/007* (2013.01)

(58) Field of Classification Search
None
See application file for complete search history.

(56) References Cited

U.S. PATENT DOCUMENTS

| | | | | |
|---|---|---|---|---|
| 7,243,723 | B2 * | 7/2007 | Surjaatmadja | E21B 34/14 166/177.5 |
| 7,357,189 | B2 * | 4/2008 | Aldaz | E21B 33/1246 166/187 |
| 7,735,559 | B2 | 6/2010 | Malone | |
| 8,511,394 | B2 | 8/2013 | Themig | |
| 9,556,714 | B2 * | 1/2017 | Hughes | E21B 43/10 |
| 9,784,070 | B2 * | 10/2017 | Neer | E21B 34/108 |
| 2010/0012318 | A1 | 1/2010 | Luce et al. | |
| 2011/0120726 | A1 | 5/2011 | Murray et al. | |
| 2016/0251939 | A1 * | 9/2016 | Johnson | E21B 34/14 166/305.1 |
| 2016/0362960 | A1 * | 12/2016 | Ross | E21B 34/14 |

FOREIGN PATENT DOCUMENTS

WO 98/05981 A1 2/1998

OTHER PUBLICATIONS

Search Report and Written Opinion of International Application No. PCT/US2016/044155 dated Nov. 4, 2016, 15 pages.
Schlumberger TAP (Treat And Produce) System, (Dec. 2007) 4 pages.

* cited by examiner

*Primary Examiner* — Matthew R Buck
*Assistant Examiner* — Douglas S Wood

(57) ABSTRACT

A system for use in treating a wellbore may include a tubular string deployed in the wellbore; and at least one valve assembly connected to the tubular string, each valve assembly for establishing communication between the tubular string and a formation zone, the at least one valve assembly comprises a sleeve having at least one fluid port therein that expands in an axial direction when the valve assembly opens to form a flowpath between an interior of the tubular string and the formation zone.

22 Claims, 10 Drawing Sheets

FRACTURING SLEEVES AND METHODS OF USE THEREOF

BACKGROUND

Hydrocarbon fluids such as oil and natural gas are obtained from a subterranean geologic formation by drilling a well that penetrates the hydrocarbon-bearing formation. This provides a partial flowpath for the hydrocarbon to reach the surface. The hydrocarbon is "produced," or travels from the formation to the wellbore (and ultimately to the surface), via a sufficiently unimpeded flowpath from the formation to the wellbore.

Hydraulic fracturing is a tool for improving well productivity by placing or extending channels from the wellbore to the formation. This operation comprises hydraulically injecting a fracturing fluid into a wellbore penetrating a subterranean formation, thus forcing the fracturing fluid against the formation strata by pressure. The formation strata or rock is thus forced to crack and fracture. Proppant may then be placed in the fracture to prevent the fracture from closing.

Oftentimes, a single wellbore will have multiple zones to be fractured. Once the casing hardware is cemented in place, stimulating applications generally take place in a zone by zone fashion. One conventional method for fracturing multiple zones involves a bottom-up approach where a lowermost zone is fractured first, and zones closer to the surface are subsequently fractured. For example, a terminal end of the well may be perforated and fractured followed by setting of a plug immediately uphole thereof. Thus, with the lowermost zone initially stimulated, the zone above the plug may now also be stimulated by way of repeating the perforating and fracturing applications. This time consuming sequence of plug setting, perforating and then fracturing is repeated for each zone.

There are many situations when one would like to selectively activate multiple downhole devices. For example, in typical wellbore operations, various treatment fluids may be pumped into the well and eventually into the formation to restore or enhance the productivity of the well. For example, a non-reactive fracturing fluid may be pumped into the wellbore to initiate and propagate fractures in the formation thus providing flow channels to facilitate movement of the hydrocarbons to the wellbore so that the hydrocarbons may be pumped from the well.

In such fracturing operations, the fracturing fluid is hydraulically injected into a wellbore penetrating the subterranean formation and is forced against the formation strata by pressure. The formation strata is forced to crack and fracture, and a proppant is placed in the fracture by movement of a viscous-fluid containing proppant into the crack in the rock. The resulting fracture, with proppant in place, provides improved flow of the recoverable fluid (i.e. oil, gas or water) into the wellbore. Often it is desirable to have multiple production zones which are treated differently within the wellbore. To isolate and treat each zone separately, previous mechanisms have been time consuming and expensive among other drawbacks.

Due to the heterogeneous nature of formation, one might not want to open all the valves simultaneously so that the fracturing operations can be performed separately for different layers of formation.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system for use in treating a wellbore that includes a tubular string deployed in the wellbore and that extends in an axial direction along the wellbore; and at least one valve assembly connected to the tubular string and configured to establish communication between an interior volume of the tubular string and a formation zone. The at least one valve assembly comprises a sleeve with at least one fluid port that expands in the axial direction when the valve assembly opens to form a flowpath between the interior volume of the tubular string and the formation zone.

In another aspect, embodiments disclosed herein relate to a system for use in treating a wellbore that includes a casing deployed in the wellbore and fixed therein by cement; and a plurality of valve assemblies connected to the casing, each valve assembly for establishing communication between the liner and a well zone and comprising a sleeve having fluid ports therein that expand in axial and radial directions when the valve assembly opens to form a flowpath between an interior of the casing and the wellbore.

In yet another aspect, embodiments disclosed herein relate to a method of treating a lateral wellbore through a formation that includes deploying a tubular string having at least one valve assembly connected thereto into the lateral wellbore; actuating the at least one valve assembly into an open configuration, thereby creating a flow path between an interior of the tubular string and the formation; delivering a treatment fluid through the opened valve assembly; and fracturing the formation along a plane that is substantially transverse to the lateral wellbore.

Other aspects and advantages of the claimed subject matter will be apparent from the following description and the appended claims.

DETAILED DESCRIPTION

In one aspect, embodiments disclosed herein relate to systems for and methods of fracturing a wellbore. Particular embodiments may be directed to multi-stage fracturing operations through a lateral wellbore using valve assemblies having fracture sleeves that may create fractures substantially transverse to the wellbore. Specifically, such fracture sleeves may have fluid ports therein that expand axially and/or radially when opened and upon application of fracture pressure. The length of the sleeve increases as measured between the top and bottom row of the slots (axial direction) and the diameter of the sleeve increases along the slotted section (radial direction).

Figure 1:
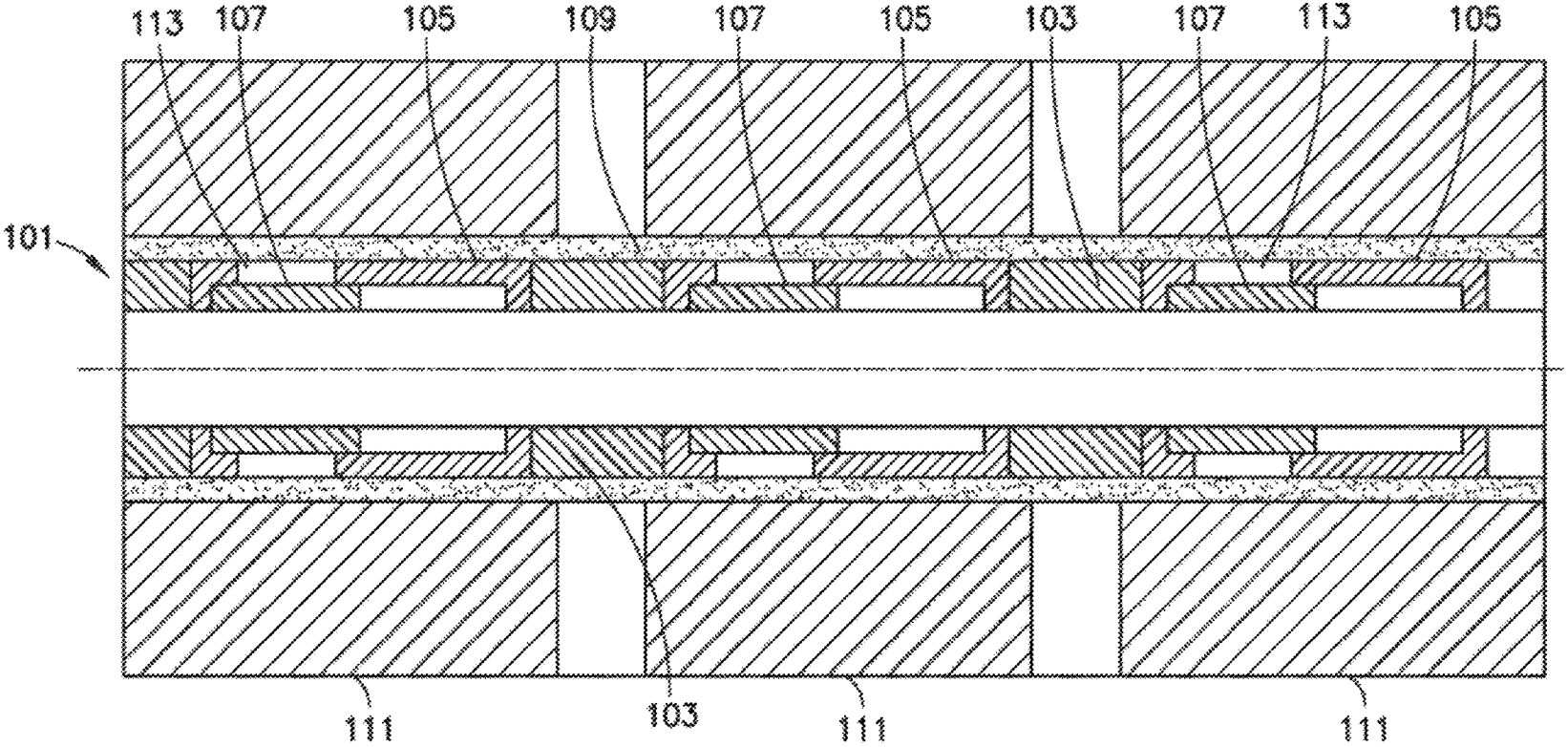
FIG. 1 shows an embodiment of a multi-stage completion system.

FIG. 1 shows a layout 101 of valves 105, sleeves 107 and formation zones 111 to be stimulated. The sleeves 107 are slideably mounted within the valves 105 to selectively open pathways 113. As illustrated, there is one valve assembly 105 per zone 111. Each valve assembly 105 is fixed in place by cement 109 and separated by casing 103. Although just three zones 111 are shown, there may be any desired number of casing valve assemblies 105 with sliding sleeves 107 cemented in a well. Upon opening of valve assemblies 105, providing a flow pathway 113 for treatment fluid to flow from an interior of the system to cement 109. Once valve assemblies 105 are opened and the internal pressure is increased, treatment fluid may initiate a crack or fracture through both cement 109 and formation zone 111. In accordance with one or more embodiments, such crack or fracture may extend along a plane substantially transverse to the casing and wellbore. In contrast, conventional valve assemblies result in a crack or fracture in a plane substantially parallel with an axis of the wellbore.

Figure 2:
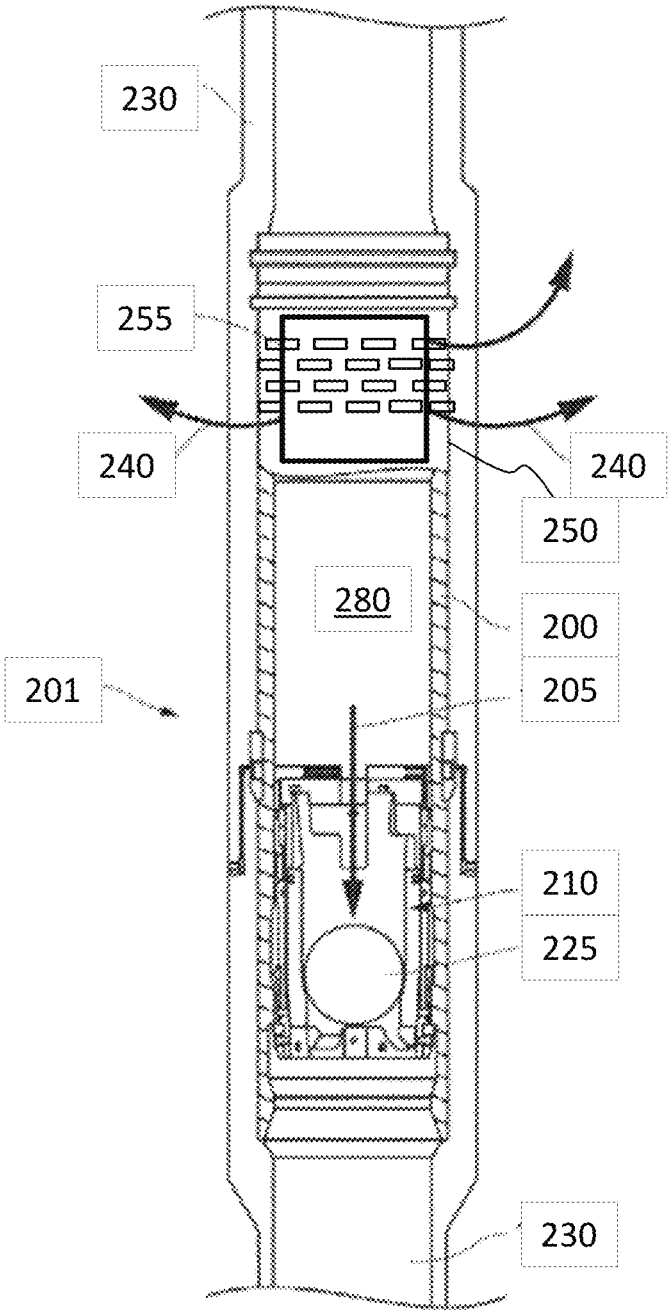
FIG. 2 shows a partial sectional view of an embodiment of a completion system.

Referring now to FIG. 2, a partially sectional view of a stimulation zone 201 is shown. This region 201 is part of a larger, more extensive casing 230 and other hardware that define a well. In the depiction of FIG. 2, fracturing fluid 240 is shown emerging from slots or side ports 255 in a fracture sleeve 250 that extends for a length of casing 230. That is, as part of stimulation operations, ultimately directed at promoting the production of well fluids, fracturing of the formation may take place through the ports 255 as shown. However, such ports 255 are not configured to always be open throughout well operations. Rather, at the outset of operations, when the casing 230 (and fracture sleeve 250) are run into the wellbore, such ports 255 are to be closed. When the ports 255 are closed, the sleeve 250 does not allow for fluid communication between the annulus and the interior of the casing 230. In accordance with embodiments of the present disclosure, the ports 255 may expand at least in an axial direction and in some embodiments, in both axial and radial directions when in an open position with pressure applied thereto.

In order to keep the ports 255 closed at the outset of well operations, an internal sliding sleeve 200 is provided that may be slid or shifted to an open position. Indeed, in the depiction of FIG. 2, the sliding sleeve 200 within the main bore 280 of the casing 230 has been shifted downward such that the ports 255 of the fracture sleeve 230 are now uncovered (see arrow 205). This is achieved by dropping of a ball 225 into the main bore 280 and pumping it through until it reaches a ball seat assembly 210. This assembly 210 includes a seat portion (not shown) that is of a diameter corresponding to that of the ball 225. Thus, the ball 225 may pass larger diameter seat portions at other stimulation regions (not shown) of the well without affecting any sleeve shifting thereat. In other words, the ball 225 is sized to target a specific seat portion 250 and open a specific sliding sleeve 200 at a specific region 201 for sake of fracturing thereat.

In a wellbore having multiple valve assemblies, as shown in FIG. 1, due to the heterogeneous nature of formation and for fracture fluid delivery and control, the valve assemblies may be opened sequentially, not simultaneously, so that the fracturing operations can be performed separately for different layers of formations. In some embodiments, graduated balls may be used to open the valves moving from the "bottom" or distal end of the wellbore towards the surface. For example, the radius of the restriction may increase from bottom up. The ball with smallest size will be first dropped into the well. The size of the ball is designed so that it will go through all the valves except the bottom valve (Casing Valve N). The ball will be stopped by the bottom valve so that the sliding sleeve of the bottom valve will be pushed to the "open" position and expose the wellbore to cemented formation. Then the fracturing operation through the valve N can be executed. After that, the next size of ball will be dropped to activate the N−1 valve.

While FIG. 2 illustrates a ball drop actuator, other actuators and actuating methods exist that may be used to open the valve assemblies of the present disclosure instead of a ball drop including, for example, using tools at the end of coil tubing or wireline to shift sleeves between the open and closed position, dropping other tethered or un-tethered objects that intelligently or mechanically mate with a target sliding sleeve to shift it either to an open or closed position and/or hydraulic pressure. Another embodiment utilizes control lines between adjacent zones to activate restrictions. Once a restriction in a particular valve is activated, it is ready to catch a dart dropped from the surface in order to open this particular valve. In embodiments involving dropping an untethered object or using a shifting tool to shift the sleeves to the open configuration, a keyway, locating feature, seat or array of seats must be placed internal to the casing at the target sleeve location to mate with the untethered object or shifting tool and create a hydraulic area to act as a piston or mechanically shift the sleeve to force it into the open configuration.

Figure 3:
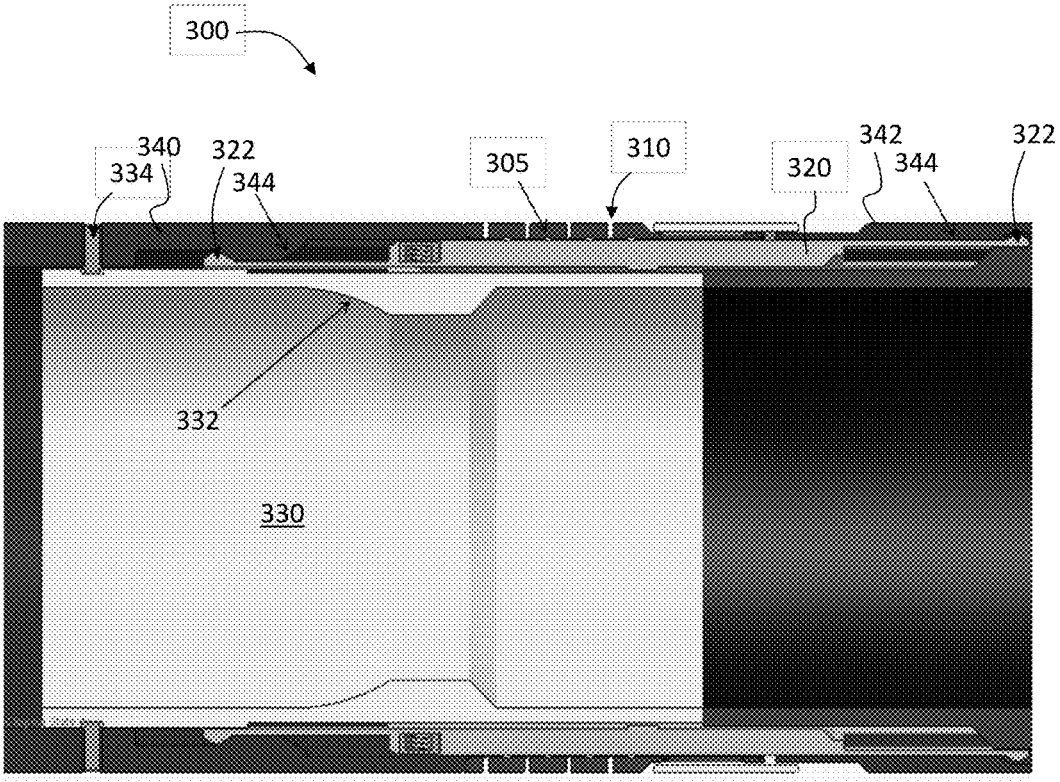
FIG. 3 shows a sectional view of an embodiment of a valve assembly in a closed configuration.
Figure 4:
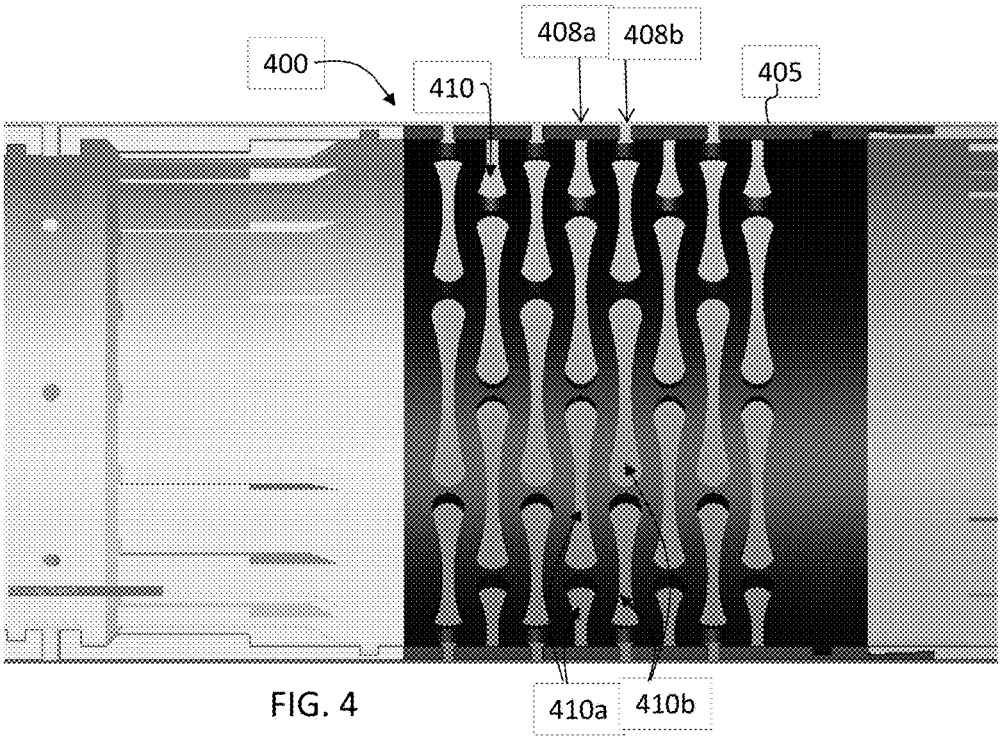
FIG. 4 shows a side view of an embodiment of a valve assembly in an open configuration.
Figure 5:
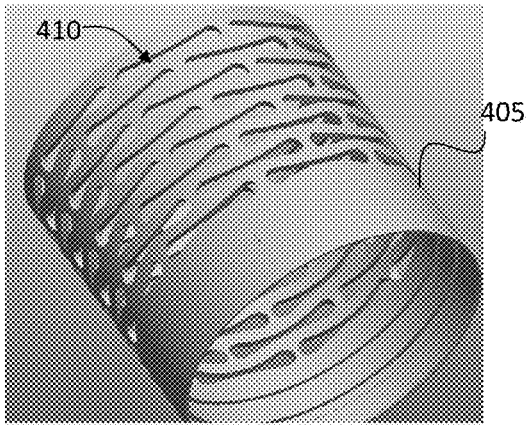
FIG. 5 shows a perspective view of an embodiment of a sleeve of a valve assembly.
Figure 6:
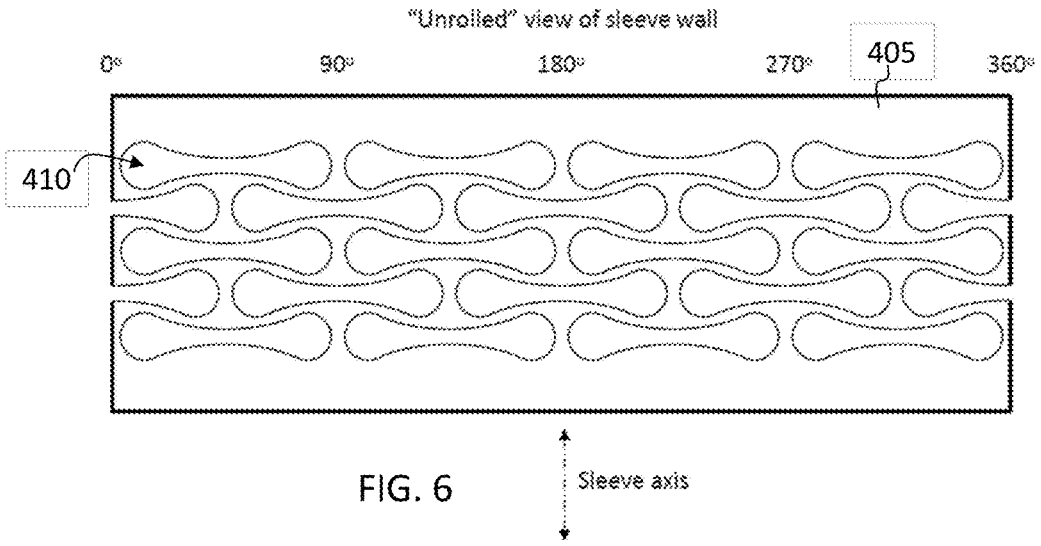
FIG. 6 shows an embodiment of a sleeve wall and port geometry in a closed configuration.
Figure 7:
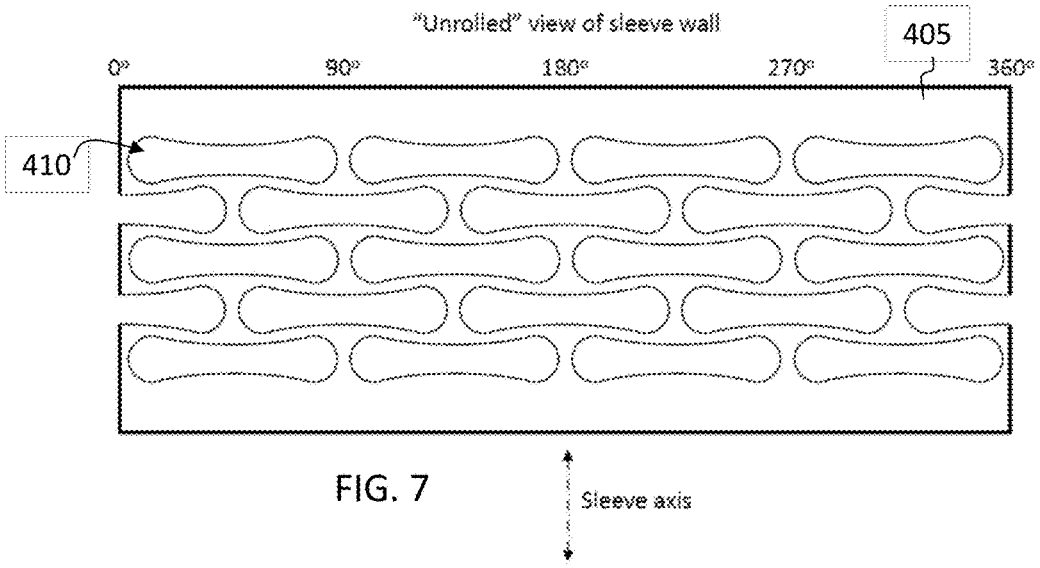
FIG. 7 shows an embodiment of a sleeve wall and port geometry in an open and pressurized configuration.
Figure 9:
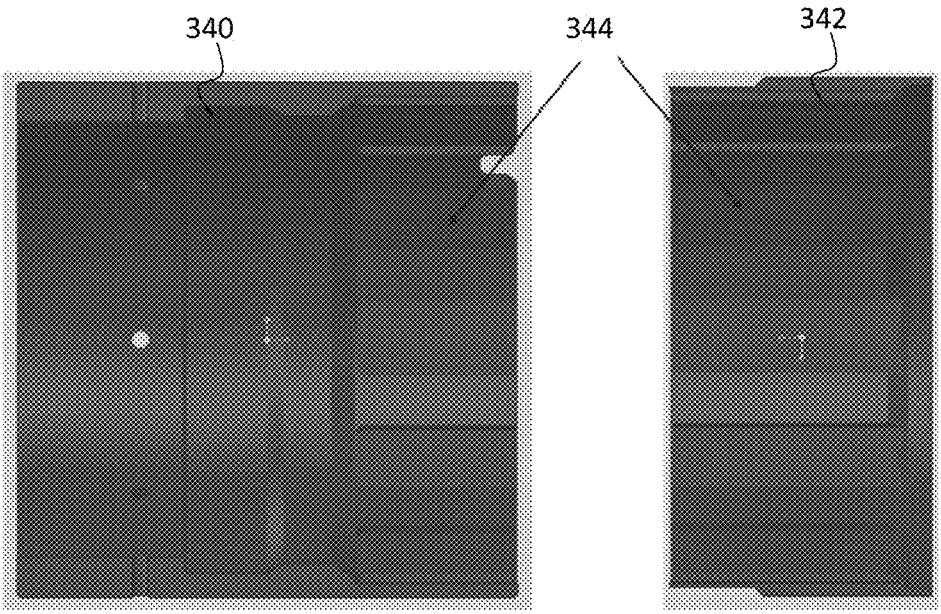
FIG. 9 shows subs used in an embodiment of a valve assembly.

FIGS. 3 and 10-13 show a cross-sectional view of a valve assembly according to an embodiment of the present disclosure. Through FIGS. 3 and 10-13, like parts are referenced by like numbers. Referring now to FIG. 3, a cross-sectional view of a valve assembly 300 in a closed configuration is shown. In this embodiment, valve assembly 300 includes a fracture sleeve 305 having fluid ports 310 formed therein. In this closed configuration, a collet 320 is concentric with fracture sleeve 305 and may help transmit torque, tension and compression around the fracture sleeve 305, particularly as the valve assembly 300 (and casing) are run into the wellbore. An inner sliding sleeve 330 is concentric within fracture sleeve 305 and collet 320 when the fracture sleeve 305 is in the closed position. Inner sliding sleeve 330 includes a seat 332 that will mate with a ball (or other untethered object) dropped from the surface when the inner sliding sleeve 330 is to shift axially downward, away from the surface, to allow for fluid to flow through fluid ports 310 formed in fracture sleeve 305. Inner sliding sleeve 330 is maintained in the closed position prior to ball dropping by the presence of shear pins 334 extending between sleeve 330 and top sub 340. Top sub 340 and bottom sub 342, which integrate valve assembly 300 into the casing string (not shown) both include internal splines 344 (also shown in FIG. 9). The collet 320 is a double ended collet including fingers 322 at each end, which engage with splines 344 of top sub 340 and bottom sub 342 to allow for the diversion of tension, compression and/or torsion loads from top sub 340 through collet 320 to bottom sub 342, substantially bypassing the fracturing sleeve as the valve assembly 300 is being run into the hole.

Figure 10:
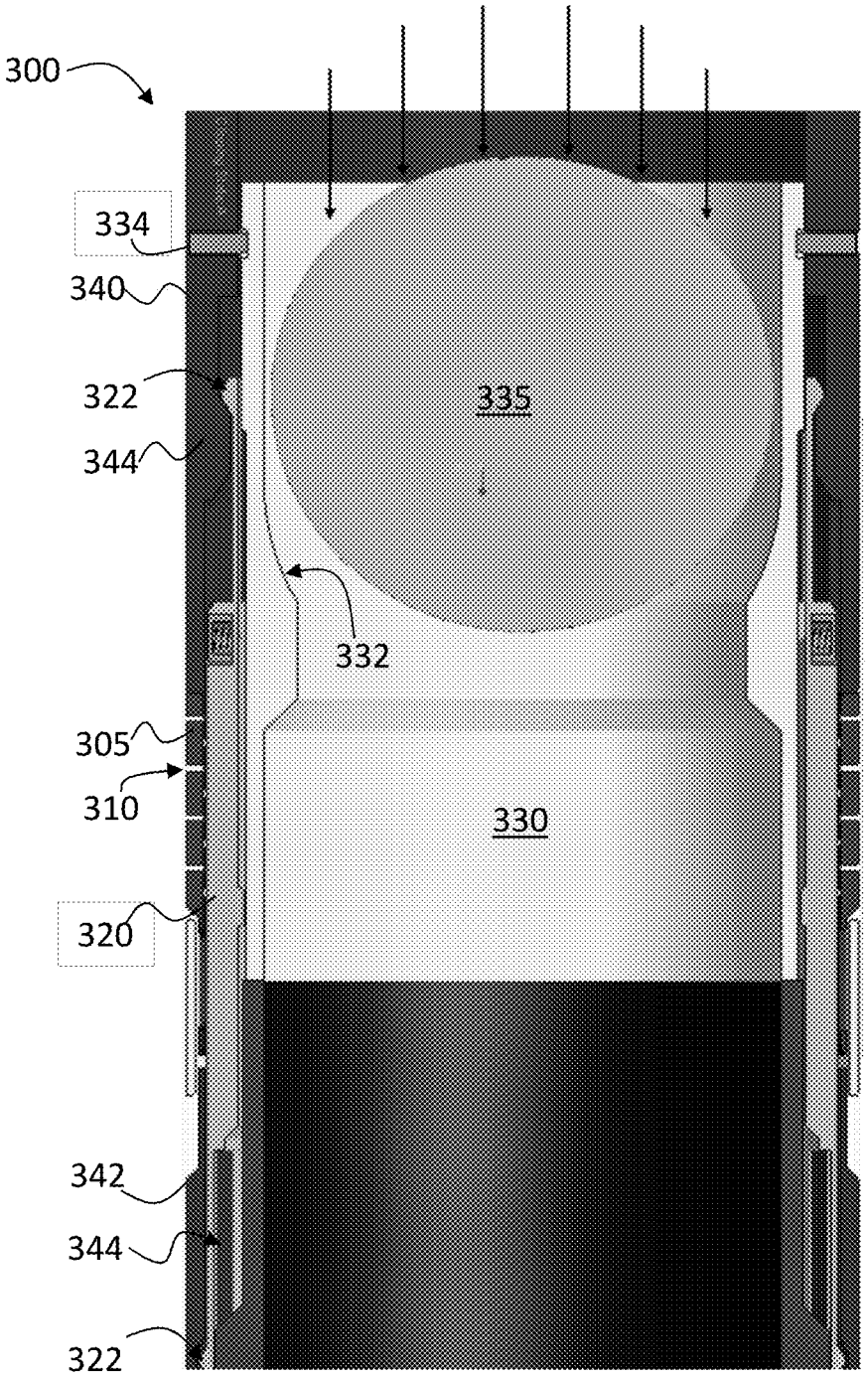
FIGS. 10-13 show an embodiment of a valve assembly as it transitions to an open configuration.
Figure 11:
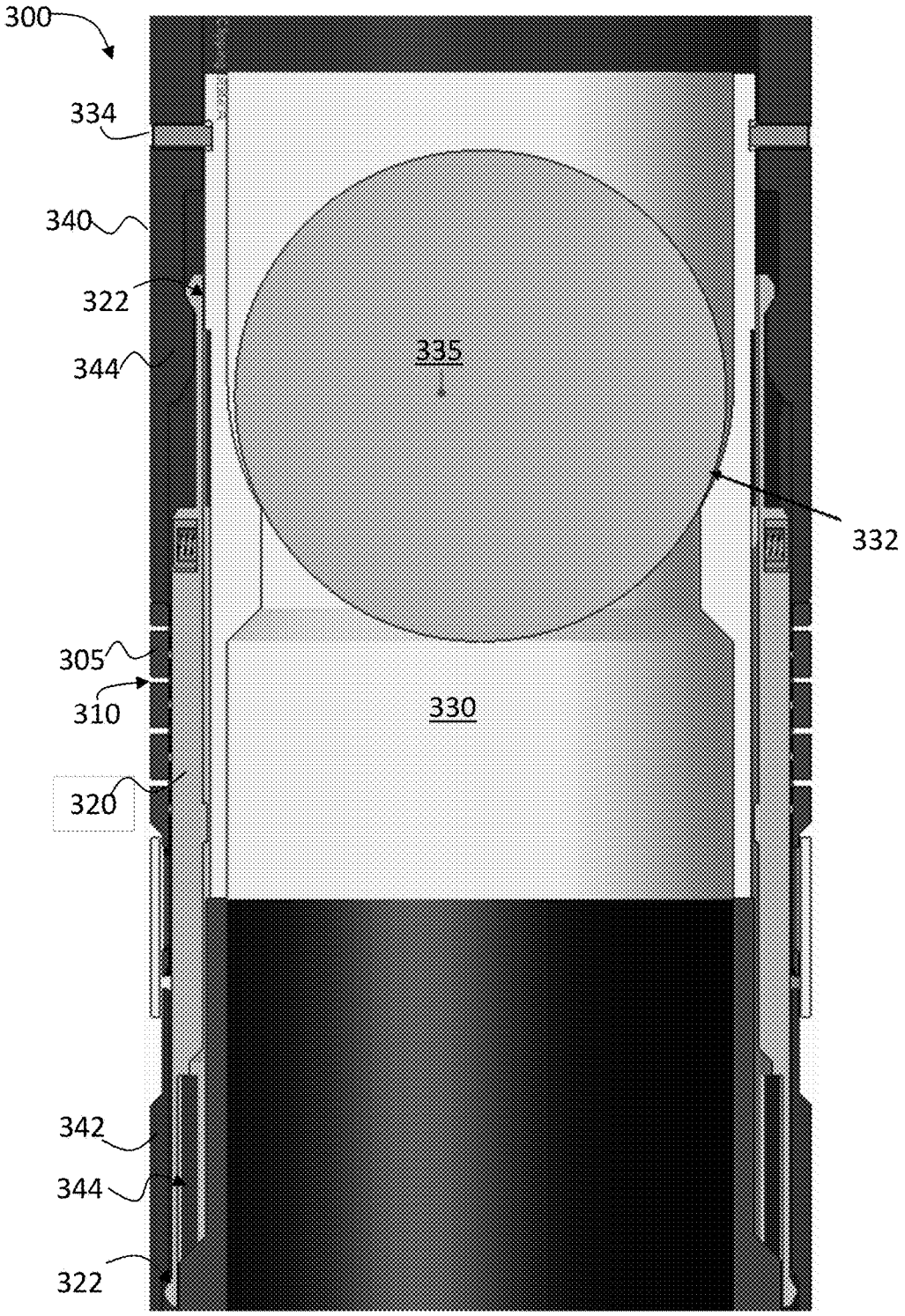
Figure 12:
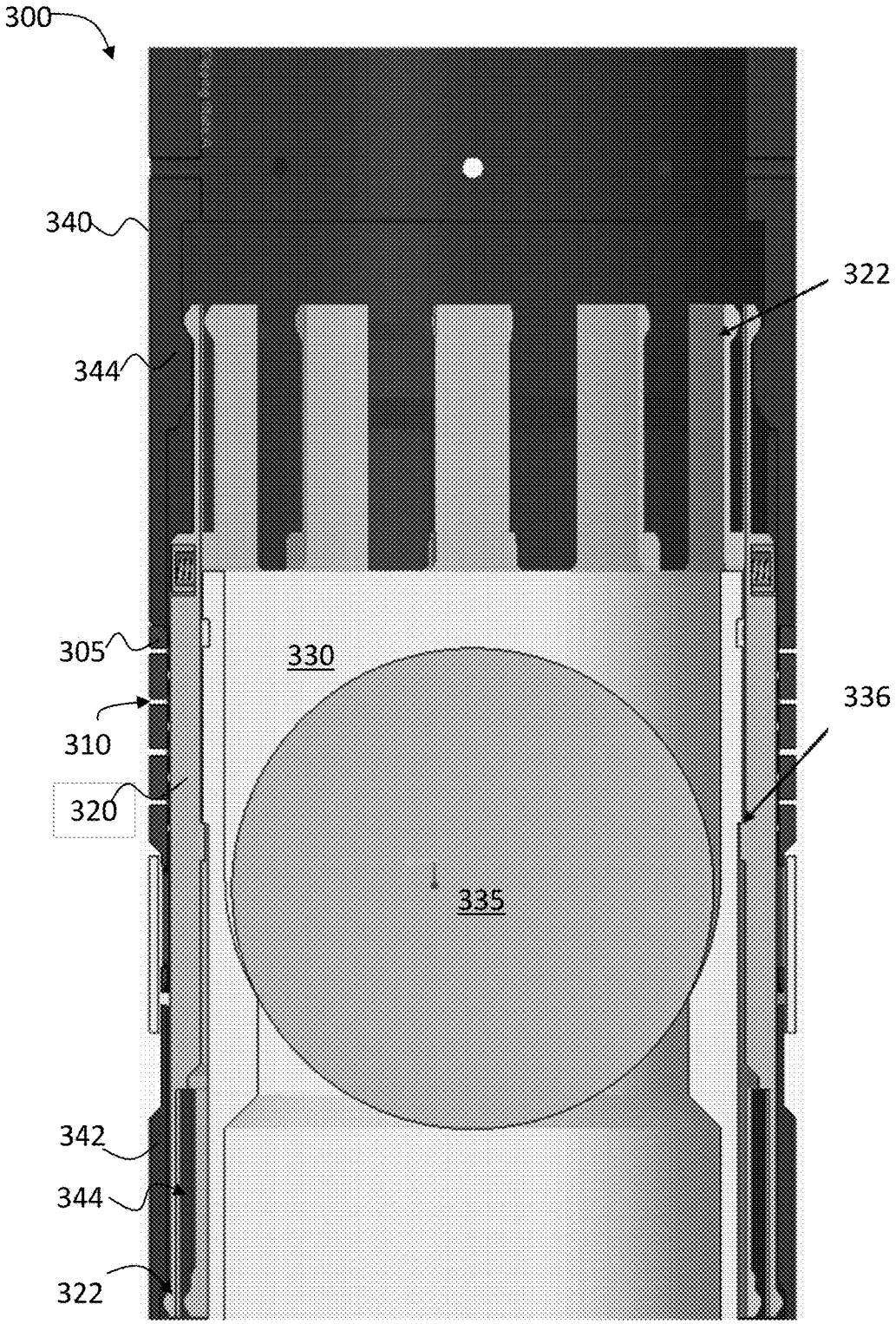
Figure 13:
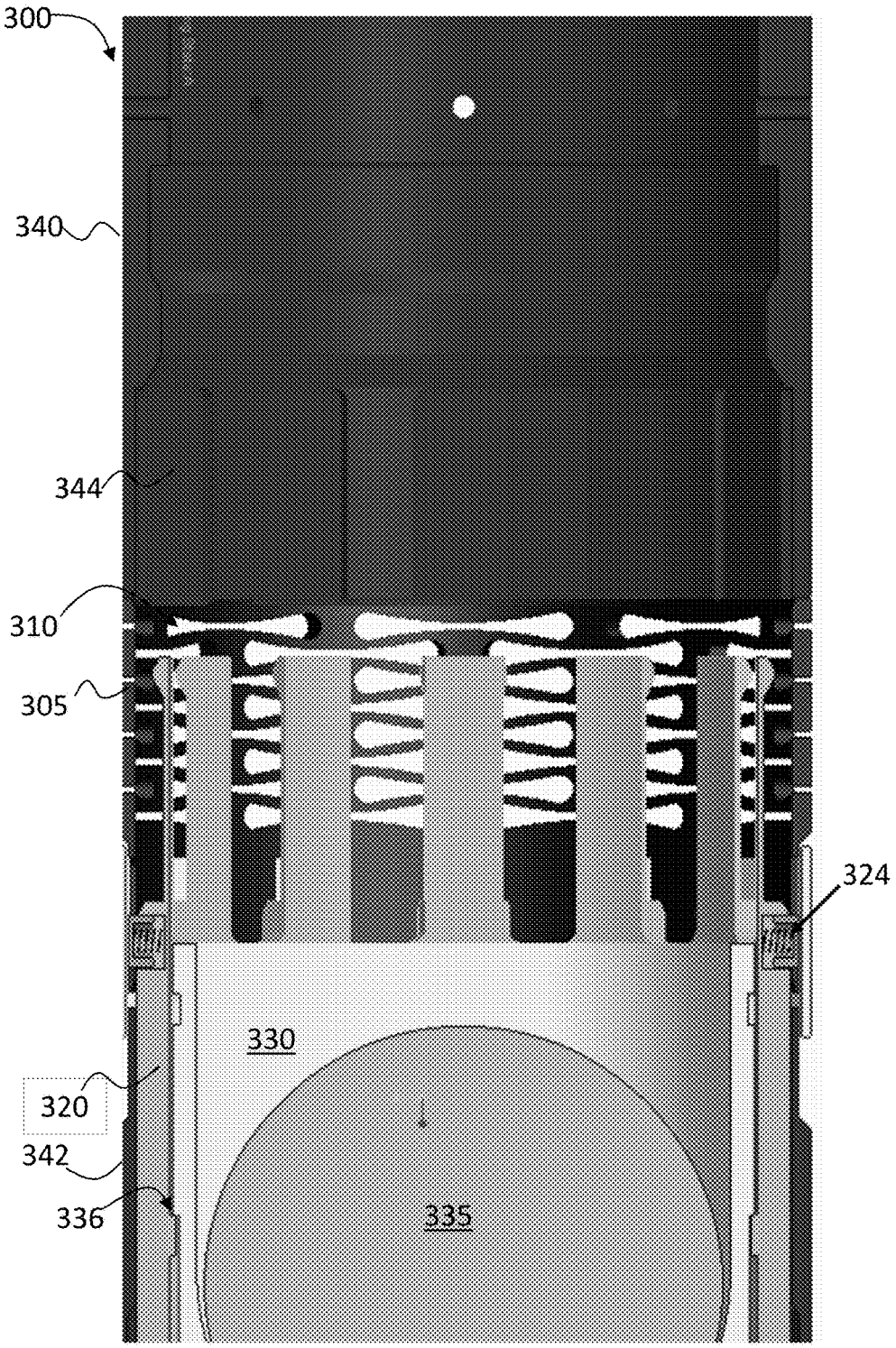

FIGS. 10-13 represent the mechanism by which the fracture sleeve 305 is exposed to the formation. Specifically, FIGS. 10-13 illustrate the configurations of the valve assembly 300 after a ball has been used to shift the components that prevent hydraulic communication between the casing annulus and casing ID out of the way, but as mentioned above, other tethered or untethered objects or a shifting tool may instead be used. In FIG. 10, a ball 335 has fallen through the internal bore of casing (not shown) and is approaching seat 332 of internal sliding sleeve 330. In FIG. 11, ball 335 has reached seat 332, but sliding sleeve 330 has not yet shifted. In both FIGS. 10 and 11, sliding sleeve 300 is still maintained in the closed position by shear pins 334, splines 344 of top sub 340 and bottom sub 342 engage with fingers 322 of collet, and fracture sleeve 305 is closed. However, in FIG. 12, inner sliding sleeve 330 has begun to shift due to hydraulic forces being exerted on ball 335. Specifically, the shear pin (shown in FIGS. 9-11 as shear pin 334) has sheared, allowing sleeve 330 to move axially downward in response to the hydraulic force experienced, past the fingers 322 of collet 320 towards, but not yet in, an open position. At this stage, collet 320 has not moved axially, relative to top sub 340, and fracture sleeve 305 and ports 310 are still closed. Sleeve 330 moves until lips 336 of sleeve 330 and collet 320 engage, which causes sleeve 330 to pull on collet 320. As sleeve 330 pulls on collet 320, because sleeve 330 has moved axially past fingers 322 of collet 320, fingers 322 are exposed and can flex radially inward and disengage from splines 344. This allows for collet 320 to move along with sleeve 330, as shown in FIG. 13.

In the last stage, shown in FIG. 13, internal sliding sleeve 330 has moved past fracture sleeve 305 into an open position. Collet 320 moves with sleeve 330 (via the engagement of lips 336) due to the hydraulic pressure exerted on ball 335. Due to this engagement, collet 320 has moved past top sub 340 and splines 344 as well as fracture sleeve 305, thereby opening fracture sleeve 305 (and fluid ports 310) and allowing for fluid communication between the annulus and the internal bore of the casing. Collet 320 is also supplied with a spring loaded locking mechanism 324, which locks into slots (not shown) formed in a distal end of fracture sleeve 305. Upon locking collet 320 to fracture sleeve 305, downward forces exerted on ball 335 may be transmitted as tensile force on fracture sleeve through locking mechanism 324. At this stage, the fracturing sleeve 305 is now ready for fracture pressure to be applied Referring now to FIGS. 4-7, other views of the fracture sleeve 305 shown in FIG. 13 are shown. As shown in FIGS. 4-7, the fluid ports 410 formed in sleeve 405 of valve assembly 400 have a substantially hour glass shape. Ports 410 are arranged in rows 408 around the circumference of sleeve 405. Further, rows 408 are spaced relative to one another such that the ports 410*a* on row 408*a* are offset relative to ports 410*b* on adjacent row 408*b*. As evident from a comparison of FIGS. 6 and 7 (showing an "unrolled" view of the sleeve wall), the geometry of ports 410 may allow for enlargement of the ports 410 as a result of internal fracture pressure, causing the sleeve to extend axially and expand radially such as a body exhibiting a negative Poisson's ratio. It is also envisioned that collet 320 (shown in FIG. 4) may pull on sleeve 305, 405 to further provide axial extension upon actuation of the valve assembly, as described above. Specifically, as described with respect to FIG. 13, the locking mechanism 324 may transmit the entire axial force caused by the hydraulic load on the ball 335 into the fracture sleeve 305. Advantageously, this effect may greatly enhance the transmitted radial and axial force of the fracture sleeve 305 on the cement and formation.

In embodiments using a cemented production casing, the radial expansion of the sleeve (against cement) may increase the normal force on the cement, aiding in the coupling, i.e., transmission of strain/stress between the casing, cement, and formation. Further, the axial extension may create a tensile force acting on the cement that translates into the formation. With the addition of high fracture pressure, this tensile force helps open up or initiate a crack through both the cement and formation at the target zone. Thus, the axial and radial expansion under fracture pressure may have an advantage over trying to fracture the formation in a purely hydraulic manner. Further, the fluid flow path created by the port geometry may result in a fracture that expands in a plane that is substantially transverse to the wellbore around the circumference of the sleeve (i.e., extending radially outward from the sleeve around about 360 degrees of the sleeve). After the fracture job is completed (each valve assembly in a multi-stage completion has been opened and the corresponding target zone fractured), production or injection fluids are allowed to flow through the slots in the sleeve which now allow hydraulic communication between the interior of the casing with the target zones that have been fractured.

Figure 8:
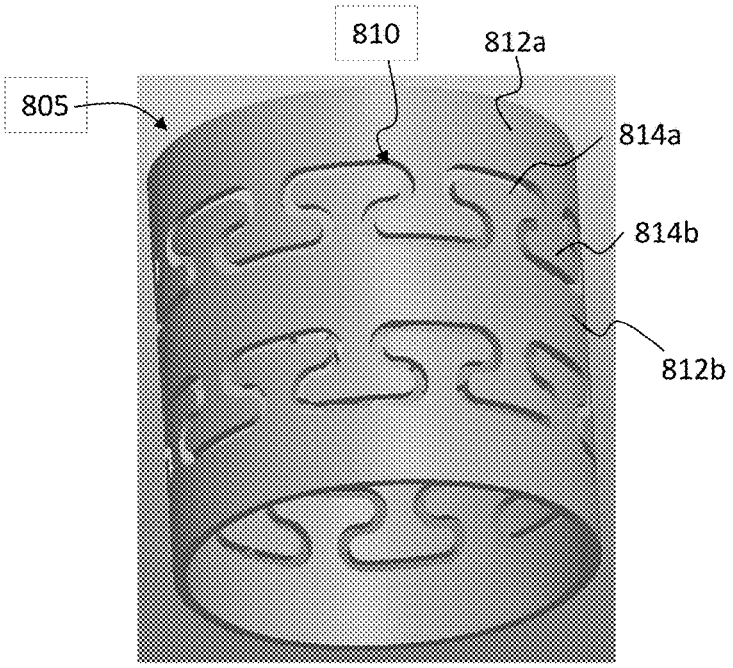
FIG. 8 shows an embodiment of a sleeve of a valve assembly.

Referring now to FIG. 8, another embodiment of a sleeve design is shown. Sleeve 805 includes a plurality of interlocking sleeve segments 812 that create fluid ports 810 therebetween. In this manner, fluid ports 810 extend around the entire circumference of the sleeve 805. Segments 812 interlock by having heads 814 (defined by the void space creating port 805) that axially and circumferentially overlap the heads 814 of an adjacent segment. That is, heads 814*a* of one segment 812*a* extend toward the adjacent segment 812*b*, thereby overlapping one another. Further, to interlock, the distal ends of heads 814*a* on one segment 812*a* extend an arc length that circumferentially overlap the arc length of the distal heads 814*b* on adjacent segment, thereby interlocking the adjacent segments to each other while also creating a fluid port 810 therebetween. The sleeve segments 812 are interlocked in such a way that the segments 812 can move (translate and rotate) with respect to each other over a limited range of motion; however they cannot come apart. This may allow the sleeve to sustain different loading conditions (tension, compression, torsion, bending) typical of when the production casing is lowered down into the wellbore. Though the illustrated embodiment shows a sleeve made of three segments 812 (and two flow ports 810), it is intended that a sleeve 805 may be formed with two or more segments 812.

Regarding use of the systems of the present disclosure, while above embodiments have referred to the valve assemblies and casing of the completion system being cemented in place as a permanent completion, the present disclosure is not so limited. Rather, in one or more embodiments, the cement serves to isolate each formation zone. Some embodiments may be deployed in a wellbore (e.g., an open or uncased hole) as a temporary completion. In such embodiments, sealing mechanisms, e.g. packers may be employed between each valve assembly and within the annulus defined by the tubular string and the wellbore to isolate the formation zones being treated with a treatment fluid.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plusfunction clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A system for use in treating a wellbore, the system comprising:

a tubular string deployed in the wellbore and that extends in an axial direction along the wellbore;

at least one valve assembly connected to the tubular string and configured to establish communication between an interior volume of the tubular string and a formation zone, wherein the at least one valve assembly comprises:

a sleeve with at least one fluid port wherein the sleeve is configured to expand in both the axial and the radial directions when an inner sleeve of the valve assembly is in an open position and the sleeve is exposed to pressure; and wherein the at least one fluid port is configured to expand in the axial direction when the inner sleeve of the valve assembly is in an open position.

2. The system of claim 1, wherein the tubular string is a casing that is fixed in the wellbore by cement.

3. The system of claim 1, wherein the at least one valve assembly comprises a plurality of valve assemblies.

4. The system of claim 3, further comprising at least one sealing mechanism between two valve assemblies within an annulus defined by the tubular string and the wellbore to isolate one well zone from another.

5. The system of claim 1, wherein each fluid port comprises an hourglass shaped slot.

6. The system of claim 5, wherein the sleeve comprises a plurality of hourglass shaped slots arranged in circumferential rows, wherein the hourglass shaped slots of one circumferential row are offset from the hourglass shaped slots of an adjacent row.

7. The system of claim 1, wherein the sleeve comprises a plurality of interlocking segments which form the at least one fluid port between the interlocking segments, wherein the at least one fluid port extends around the circumference of the sleeve.

8. The system of claim 1, further comprising: at least one actuator coupled to the at least one valve assembly, the at least one actuator configured to move the inner sleeve into an open position and establish a flowpath.

9. The system of claim 1, wherein the valve assembly bypasses one or more of tension, compression, and/or torsion forces around the sleeve.

10. A system for use in treating a wellbore, comprising a casing deployed in the wellbore and fixed therein by cement; and a plurality of valve assemblies connected to the casing, each valve assembly for establishing fluid communication between the casing and a formation zone, the valve assembly comprising;

a sleeve having fluid ports therein wherein each fluid port comprises an hourglass shaped slot, and wherein the sleeve expands in both an axial and a radial direction when an inner sleeve of the valve assembly is in an open position and the fluid ports expand in an axial direction from a flowpath between an interior of the casing and the well bore.

11. The system of claim 10, wherein the sleeve comprises a plurality of hourglass shaped slots arranged in circumferential rows, wherein the hourglass shaped slots of one circumferential row are offset from the hourglass shaped slots of an adjacent row.

12. The system of claim 10, further comprising: at least one actuator coupled to the at least one valve assembly, the at least one actuator configured to move the inner sleeve of the valve assembly into an open position and establish the flowpath.

13. The system of claim 10, wherein the valve assembly bypasses one or more of tension, compression, and/or torsion forces around the sleeve.

14. A method of treating a lateral wellbore through a formation, comprising:

deploying a tubular string having at least one valve assembly connected thereto into the lateral wellbore;

actuating an inner sleeve of the at least one valve assembly into an open configuration, thereby creating a flow path between an interior of the tubular string and the formation;

delivering a treatment fluid through the opened valve assembly;

expanding a sleeve of the at least one valve assembly in both an axial and a radial direction; and fracturing the formation along a plane that is substantially transverse to the lateral wellbore.

15. The method of claim 14, wherein the sleeve has at least one fluid port therein that expands in an axial direction when the inner sleeve of the valve assembly opens to form the flow path.

16. The method of claim 15, wherein the at least one fluid port expands in both axial and radial directions.

17. The method of claim 16, wherein each fluid port comprises an hourglass shaped slot.

18. The method of claim 17, wherein the sleeve comprises a plurality of hourglass shaped slots arranged in circumferential rows, wherein the hourglass shaped slots of one circumferential row are offset from the hourglass shaped slots of an adjacent row.

19. The method of claim 15, wherein the at least one fluid port extends around the circumference of the sleeve and is formed by interlocking segments of the sleeve.

20. The method of claim 15, further comprising:

bypassing one or more of tension, compression, and/or torsion forces around the sleeve.

21. The system of claim 1, wherein the sleeve is a fracturing sleeve.

22. The system of claim 1, wherein the internal sleeve is a sliding sleeve.

* * * * *